US009175428B2

(12) United States Patent
Huang et al.

(10) Patent No.: US 9,175,428 B2
(45) Date of Patent: Nov. 3, 2015

(54) METHOD OF MAKING A DOUBLE-SIDED EMBOSSED NON-WOVEN FABRIC

(76) Inventors: Chen-Cheng Huang, Taipei (TW); Pao-Hao Huang, Taipei (TW); Pao-Han Huang, Taipei (TW)

( * ) Notice: Subject to any disclaimer, the term of this patent is extended or adjusted under 35 U.S.C. 154(b) by 346 days.

(21) Appl. No.: 13/459,549

(22) Filed: Apr. 30, 2012

(65) Prior Publication Data

US 2013/0285294 A1 Oct. 31, 2013

(51) Int. Cl.

| | |
|---|---|
| ***D04H 13/00*** | (2006.01) |
| ***D04H 1/54*** | (2012.01) |
| ***D04H 1/70*** | (2012.01) |

(52) U.S. Cl.

CPC ..... *D04H 13/00* (2013.01); *D04H 1/54* (2013.01); *D04H 1/70* (2013.01)

(58) Field of Classification Search

None

See application file for complete search history.

(56) References Cited

U.S. PATENT DOCUMENTS

| | | | | |
|---|---|---|---|---|
| 3,322,617 | A | 5/1967 | Osborne | |
| 4,741,941 | A | 5/1988 | Englebert et al. | |
| 5,143,774 | A * | 9/1992 | Cancio et al. | 428/169 |
| 5,399,174 | A * | 3/1995 | Yeo et al. | 604/365 |
| 5,555,801 | A | 9/1996 | Kroyer | |
| 5,575,874 | A | 11/1996 | Griesbach, III et al. | |
| 7,530,150 | B2 | 5/2009 | Brennan et al. | |
| 2003/0201579 | A1 | 10/2003 | Gordon et al. | |
| 2012/0066855 | A1 | 3/2012 | Schmidt et al. | |

FOREIGN PATENT DOCUMENTS

| | | | |
|---|---|---|---|
| CN | 1273288 | C | 9/2006 |
| DE | 39 20 066 | A1 | 1/1991 |
| DE | 41 23 122 | A1 | 1/1993 |
| DE | 10 2005 055 607 | B3 | 3/2007 |
| EP | 1 217 107 | A1 | 6/2002 |
| EP | 1 228 798 | A1 | 8/2002 |
| EP | 1 430 861 | A1 | 6/2004 |
| EP | 1 455 050 | A1 | 9/2004 |
| EP | 1 455 080 | A2 | 9/2004 |
| GB | 1063672 | | 3/1967 |
| TW | 200806456 | A | 2/2008 |
| WO | WO 92/16361 | A1 | 10/1992 |
| WO | WO 99/44809 | A1 | 9/1999 |
| WO | WO 2005/013873 | A1 | 2/2005 |
| WO | WO 2007/053204 | A1 | 5/2007 |

OTHER PUBLICATIONS

Hutten, "Process for Nonwoven Filter Media," Handbook of Nonwoven Filter Media, 2007, pp. 209-219.

* cited by examiner

*Primary Examiner* — Monica Huson

(74) *Attorney, Agent, or Firm* — Muncy, Geissler, Olds & Lowe, P.C.

(57) ABSTRACT

A method of making a double-sided embossed non-woven fabric includes: forming a stack of semi-molten fibers on a screen assembly, the screen assembly including a first layer structure that has a plurality of suction holes arranged into a first pattern, and a second layer structure that is disposed on the first layer structure and that has a plurality of elements arranged into a second pattern; and embossing the stack of the semi-molten fibers on the screen assembly by suctioning the stack of the semi-molten fibers using a suctioning device such that the stack of the semi-molten fibers is drawn into the holes to wrap the elements.

10 Claims, 6 Drawing Sheets

METHOD OF MAKING A DOUBLE-SIDED EMBOSSED NON-WOVEN FABRIC

BACKGROUND OF THE INVENTION

1. Field of the Invention

This invention relates to a method of making a double-sided embossed non-woven fabric, more particularly to a method involving suctioning a stack of semi-molten fibers on a screen assembly to form a double-sided embossed non-woven fabric.

2. Description of the Related Art

U.S. Pat. No. 5,555,801 discloses a method of making a double-sided embossed fibrous web. The method is capable of overcoming a tendency of undesirably breaking or rupturing the fibrous web during embossing by using conventional embossing rollers. The method of the patent includes passing a fibrous web through a nip between a pressure roller and an embossing roller. The pressure roller has a smooth and hard surface so as to create the effect of a double sided three dimensional embossing on the fibrous web. However, the method is disadvantageous in that the material of the embossed regions of the embossed fibrous web that are brought into contact with the pressure and embossing rollers is undesirably hardened and shrunk due to melting, pressurizing and cooling of the material in the embossing process. In addition, the thickness of the embossed regions tends to become thinner as compared to that of the non-embossed regions of the embossed fibrous web.

SUMMARY OF THE INVENTION

Therefore, the object of the present invention is to provide a method of making a double-sided embossed non-woven fabric that can overcome the aforementioned drawbacks associated with the prior art.

According to the present invention, there is provided a method of making a double-sided embossed non-woven fabric. The method comprises: forming a stack of semi-molten fibers on a screen assembly on a suctioning device, the screen assembly including a first layer structure that has a plurality of suction holes arranged into a first pattern, and a second layer structure that is disposed on the first layer structure and that has a plurality of elements arranged into a second pattern; and embossing the stack of the semi-molten fibers on the screen assembly by suctioning the stack of the semi-molten fibers using the suctioning device such that the stack of the semi-molten fibers is drawn into the holes to wrap the elements, thereby forming the stack of the semi-molten fibers into a non-woven fabric with a raised pattern corresponding to the second pattern of the screen assembly and a recess pattern corresponding to the first pattern of the screen assembly.

BRIEF DESCRIPTION OF THE DRAWINGS

In drawings which illustrate embodiments of the invention.

DETAILED DESCRIPTION OF THE PREFERRED EMBODIMENTS

Figure 1:
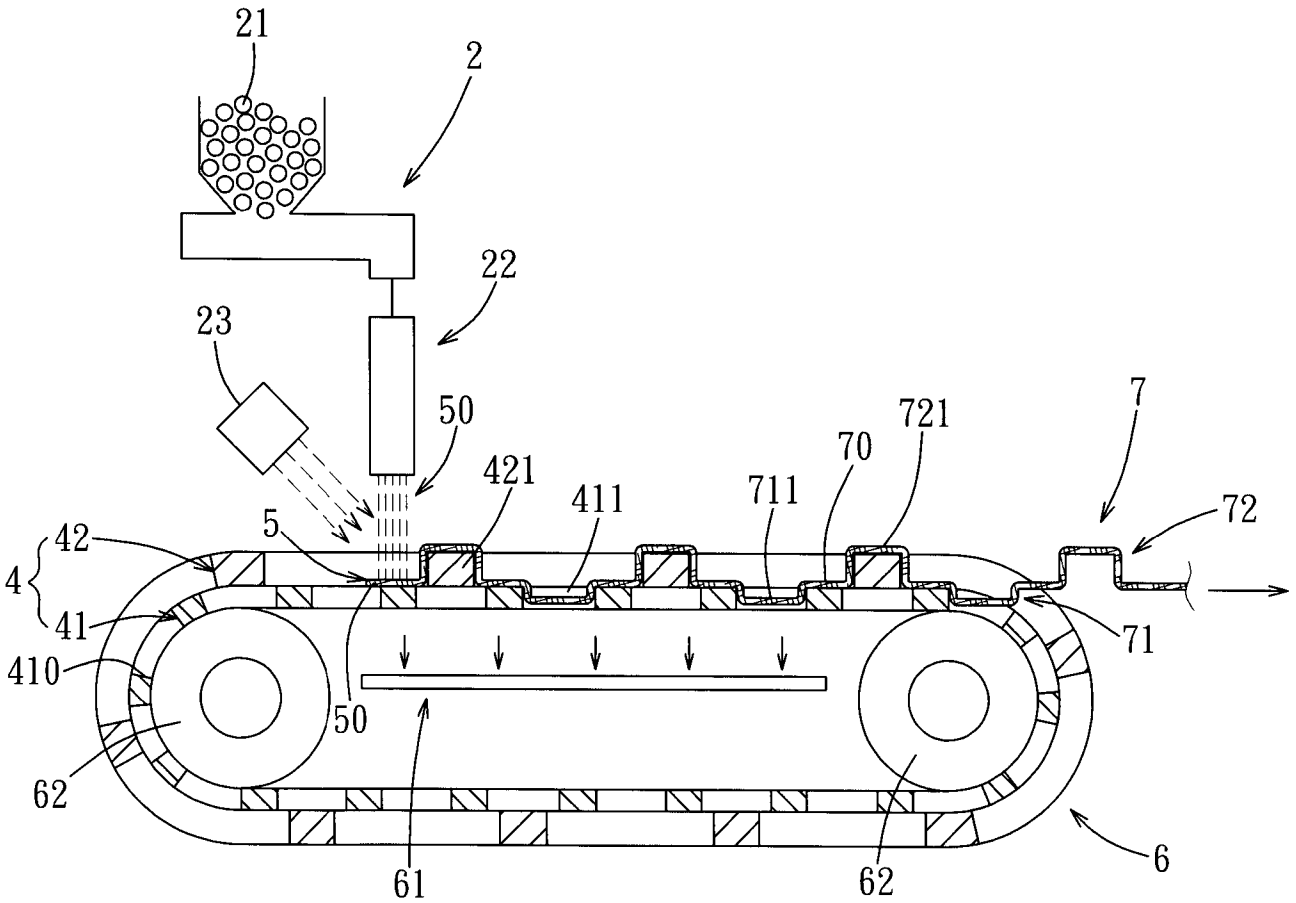
FIG. 1 is a schematic sectional view illustrating an apparatus employed in the first preferred embodiment of a method of making a double-sided embossed non-woven fabric according to the present invention.

Before the present invention is described in greater detail with reference to the accompanying preferred embodiments, it should be noted herein that like elements are denoted by the same reference numerals throughout the disclosure.

Figure 2:
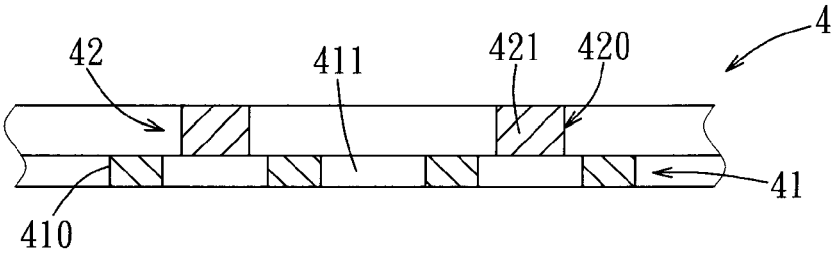
FIG. 2 is a fragmentary sectional view of a screen assembly used in the first preferred embodiment.
Figure 3:
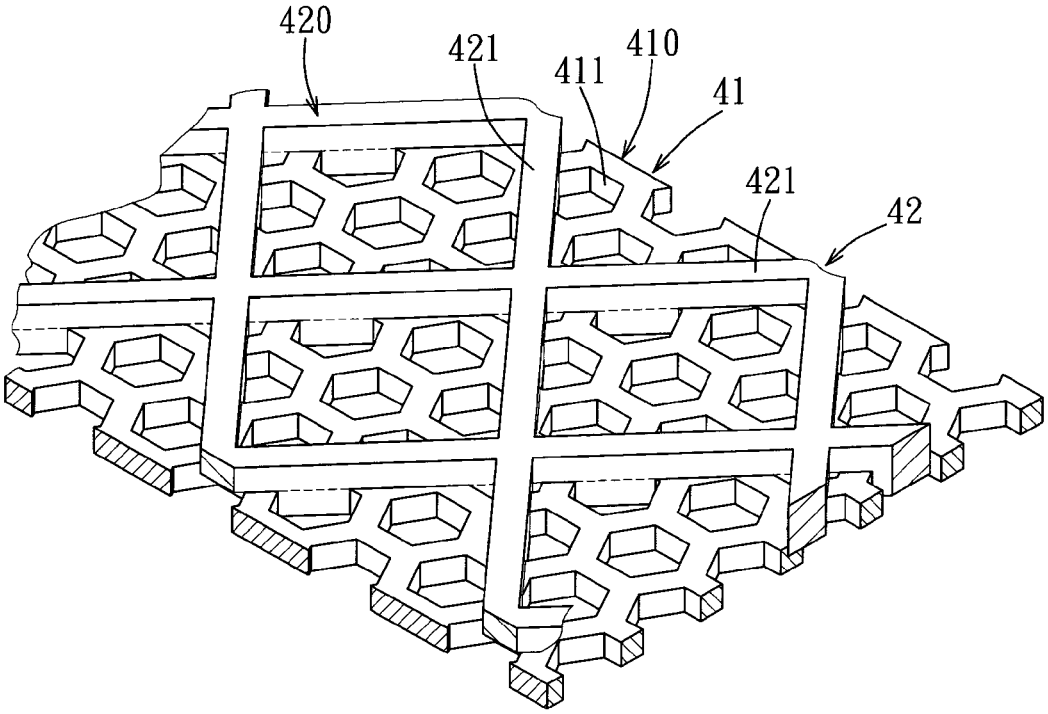
FIG. 3 is a fragmentary perspective view of the screen assembly used in the first preferred embodiment.

FIGS. 1 to 3 illustrate an apparatus employed in the first preferred embodiment of a method of making a double-sided embossed non-woven fabric according to the present invention. The double-sided embossed non-woven fabric can be used as an air permeable substrate of an article, such as a diaper, a filtering medium, a surgical gown, or a hospital bedsheet.

The method includes the steps of: directly stacking semi-molten fibers 50 (the term "semi-molten" as used herein represents a state in which liquid and solid phases coexists) on a screen assembly 4 on a suctioning device 6 so as to form an air permeable stack 5 of the semi-molten fibers 50 on the screen assembly 4, the screen assembly 4 including a first layer structure 41 that has a screen wall body 410 and that has a plurality of suction holes 411 formed in the screen wall body 410 and arranged into a first pattern, and a second layer structure 42 that is disposed on the screen wall body 410 of the first layer structure 41 and that has a plurality of elements 421 arranged into a second pattern; and embossing the stack 5 of the semi-molten fibers 50 on the screen assembly 4 by suctioning the stack 5 of the semi-molten fibers 50 using the suctioning device 6 such that the stack 5 of the semi-molten fibers 50 is drawn into the holes 411 to wrap the elements 421 and an area of the screen wall body 410 which is not covered by the second layer structure 42, thereby forming the stack 5 of the semi-molten fibers 50 into a non-woven fabric 7 having a base portion 70 covering the area of the screen wall body 410, a first level 71 of recessed portions 711 extending downwardly from the base portion 70 and having a recess pattern corresponding to the first pattern, and a second level 72 of protuberant portions 721 extending upwardly from the base portion 70 and having a raised pattern corresponding to the second pattern. It is noted that fiber-to-fiber bonding among the semi-molten fibers 50 of the stack 5 occurs during the embossing step.

In this embodiment, the stack 5 of the semi-molten fibers 50 is formed by melting raw materials 21, such as resin pellets, wood fibers and plastic fibers, using an extruder 2 to form a melt, followed by feeding the melt through a fiber-forming device 22 to form the semi-molten fibers 50 and subsequently and directly discharging the semi-molten fibers 50 from the fiber-forming device 22 onto the screen assembly 4.

In this embodiment, the fiber-forming device 22 is a spinnerette which is used for forming spunbound fibers. Alternatively, the fiber-forming device 22 can be a melt-blowing die which is used for forming meltblown fibers.

Preferably, the method of this invention further includes a step of heating the semi-molten fibers 50 using a heater 23 during discharging of the semi-molten fibers 50 from the fiber-forming device 22 onto the screen assembly 4 so as to control and maintain a desired melt viscosity of the semi-molten fibers 50 and to facilitate formation of the non-woven fabric 7 in the subsequent embossing process.

In this embodiment, the elements 421 are in the form of elongate ribs that are formed into a net body 420 (see FIG. 3).

In this embodiment, the suctioning device 6 is a conveyor-type suction device and includes a suction box 61 surrounded by the screen assembly 4. The screen wall body 410 serves as a conveyor belt trained on and driven by a pair of driving wheels 62.

Figure 4:
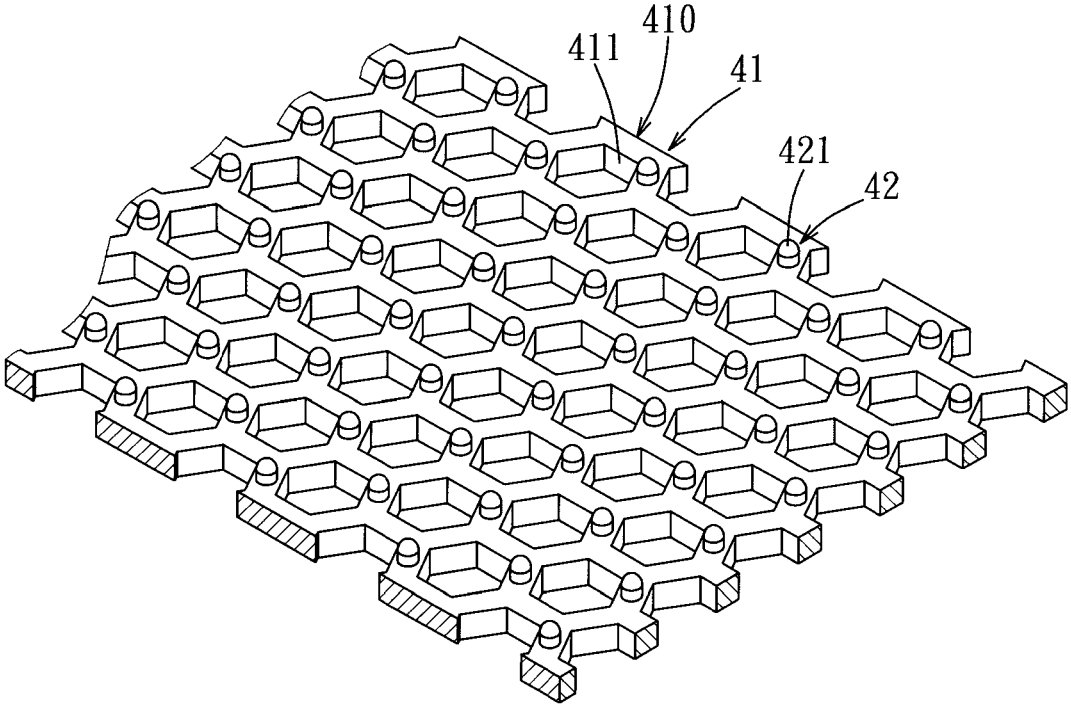
FIG. 4 is a fragmentary perspective view of a modified screen assembly modified from that of the first preferred embodiment.

The screen assembly 4 can be modified into one having more layer structures (not shown) or having a structure shown in FIG. 4. The modified screen assembly 4 differs from the screen assembly of FIG. 3 in that the elements 421 of the second layer structure 42 of the modified screen assembly 4 are in the form of isolated protrusions disposed on the screen wall body 410.

Figure 5:
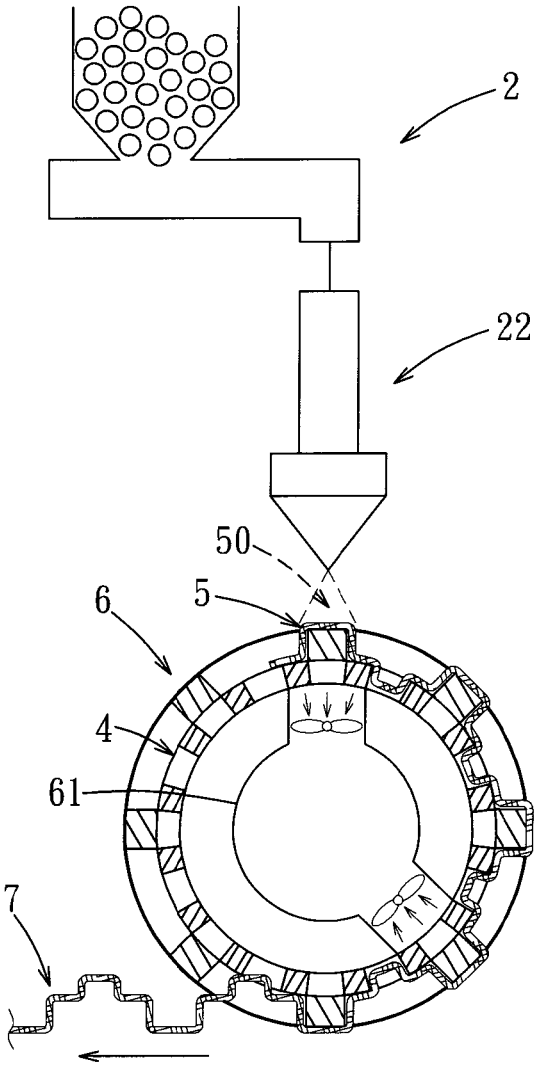
FIG. 5 is a sectional view of a modified suctioning device modified from that of the first preferred embodiment.

Alternatively, the suctioning device 6 can be a drum-type suction device (see FIG. 5), which includes a suction box 61 surrounded by the screen assembly 4 that is cylindrical in shape, and a central shaft (not shown) for mounting of the screen assembly 4.

In a modified embodiment, formation of the stack 5 of the semi-molten fibers 50 on the screen assembly 4 can be conducted by directly stacking non-molten fibers onto the screen assembly 4 to form a stack of the non-molten fibers, followed by passing the stack of the non-molten fibers through a heater or an oven (not shown) so as to form the non-molten fibers into the semi-molten fibers 50.

Figure 6:
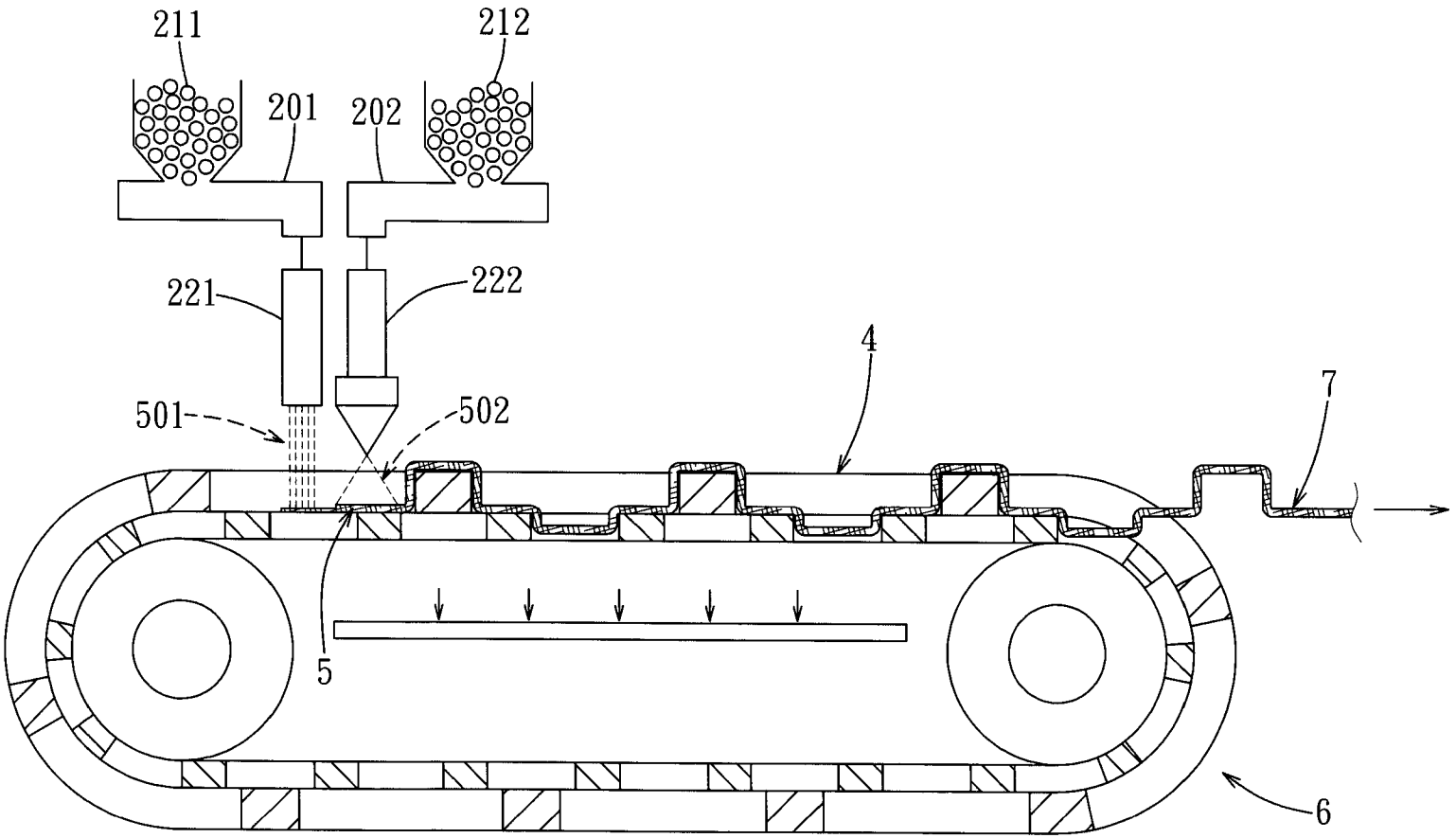
FIG. 6 is a schematic sectional view illustrating an apparatus employed in the second preferred embodiment of a method of making a double-sided embossed non-woven fabric according to the present invention.

FIG. 6 illustrates an apparatus employed in the second preferred embodiment of a method of making a double-sided embossed non-woven fabric according to the present invention. The second preferred embodiment differs from the previous embodiment in that the stack 5 of the semi-molten fibers 50 includes a plurality of first semi-molten fibers 501 and a plurality of second semi-molten fibers 502, that the first semi-molten fibers 501 are formed by melting first resin pellets 211 using a first extruder 201 to form a first melt, followed by feeding the first melt through a spinnerette 221, and that the second semi-molten fibers 502 are formed by melting second resin pellets 212 using a second extruder 202 to forma second melt, followed by feeding the second melt through a melt-blowing die 222.

Figure 7:
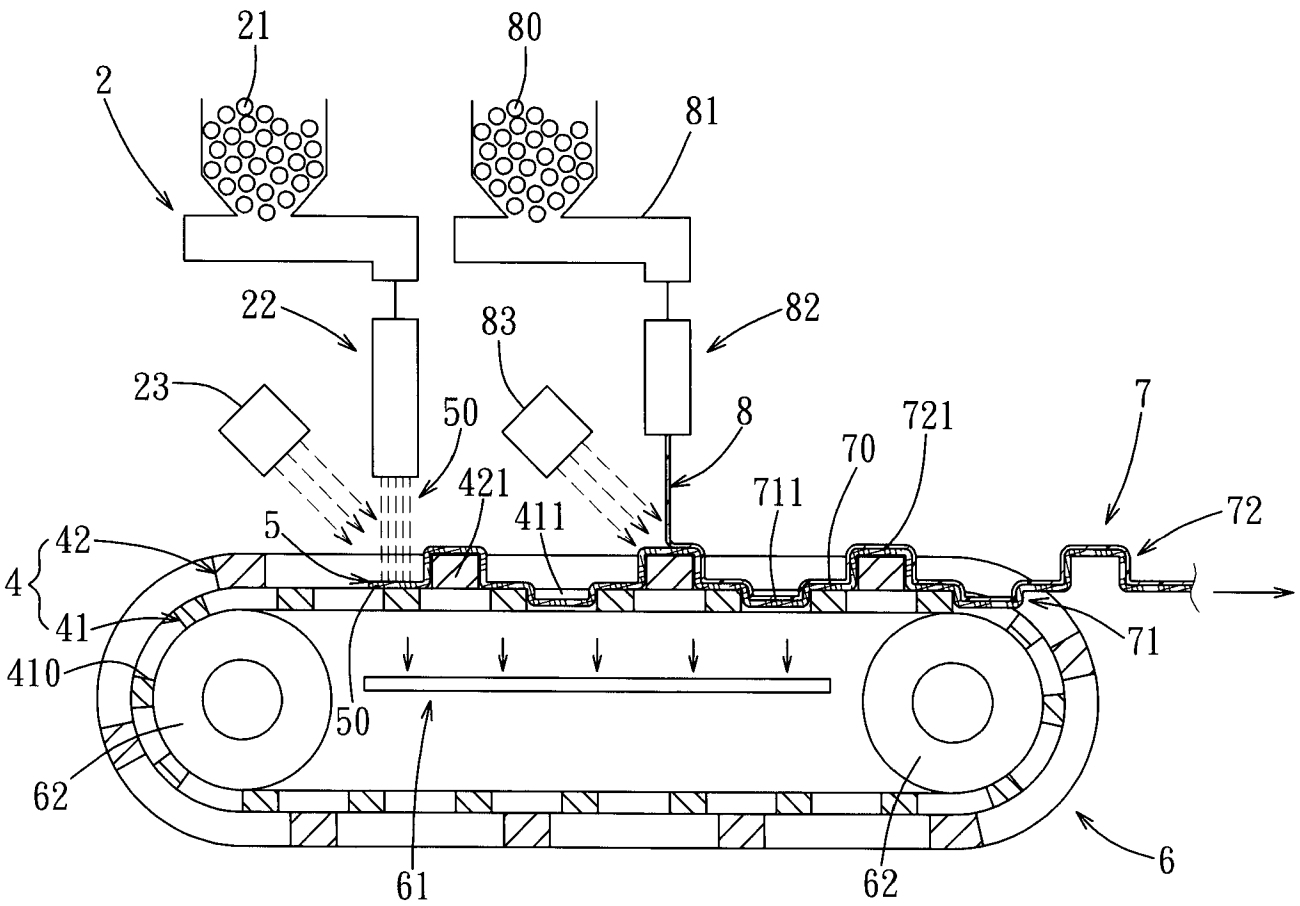
FIG. 7 is a schematic sectional view illustrating an apparatus employed in a method of making a fabric web containing a double-sided embossed non-woven fabric according to the present invention.

FIG. 7 illustrates an apparatus employed in a method of making a fabric web containing the double-sided embossed non-woven fabric according to the present invention. The method includes: forming the double-sided embossed non-woven fabric 7 according to the first preferred embodiment, extruding a plastic raw material 80 to form a plastic film 8 (which is in a semi-molten state) using an extruder 81 with an elongate extruding die 82, and subsequently casting the plastic film 8 to the double-sided embossed non-woven fabric 7 such that the plastic film 8 is bonded to the double-sided embossed non-woven fabric 7 and has patterns conforming to the raised pattern and the recess pattern of the double-sided embossed non-woven fabric 7, respectively. A heater 83 is used for controlling the semi-molten state of the plastic film 8 and for softening the double-sided embossed non-woven fabric 7 when necessary to facilitate bonding between the plastic film 8 and the double-sided embossed non-woven fabric 7. The plastic film 8 forms an air impermeable barrier for the fabric web thus formed.

By stacking the semi-molten fibers 50 on the screen assembly 4, followed by suctioning the stack 5 of the semi-molten fibers 50 in a manner to draw the stack 5 into the suction holes 411 according to the method of this invention, the aforesaid drawbacks associated with the prior art can be alleviated. In addition, the heating of the semi-molten fibers 50 during discharging thereof onto the screen assembly 4 to control the melt viscosity of the stack 5 can facilitate formation of the double-sided embossed non-woven fabric 7.

With the invention thus explained, it is apparent that various modifications and variations can be made without departing from the spirit of the present invention. It is therefore intended that the invention be limited only as recited in the appended claims.

What is claimed is:

1. A method of making a double-sided embossed non-woven fabric, comprising:

forming a stack of semi-molten fibers on a screen assembly on a suctioning device, the screen assembly including a first layer structure that has a screen well body and a plurality of recessed suction holes formed in the screen wall body and arranged into a first pattern, and a second layer structure that is disposed on the first layer structure and that has a plurality of raised elements disposed on the screen wall body and arranged into a second pattern, wherein the stack of the semi-molten fibers is formed by melting resin pellets to form a melt, followed by feeding the melt through a fiber-forming device to form the semi-molten fibers and subsequently discharging the semi-molten fibers from the fiber-forming device onto the screen assembly; and embossing the stack of the semi-molten fibers on the screen assembly by suctioning the stack of the semi-molten fibers using the suctioning device such that the stack of the semi-molten fibers is drawn into the recessed suction holes to wrap the raised elements and an area of the screen wall body which is not covered by the second layer structure, thereby forming the stack of the semi-molten fibers into a non-woven fabric having a base portion covering the area of the screen wall body, a first level of recessed portions extending downwardly from the base portion and having a recess pattern corresponding to the first pattern of the screen assembly, and a second level of protuberant portions extending upwardly from the base portion and having a raised pattern corresponding to the second pattern.

2. The method of claim 1, wherein formation of the stack of the semi-molten fibers on the screen assembly is conducted by directly stacking the semi-molten fibers onto the screen assembly.

3. The method of claim 1, wherein the raised elements being in the form of isolated protrusions disposed on the screen wall body.

4. The method of claim 1, wherein the raised elements being in the form of elongate ribs that are formed into a net body.

5. The method of claim 1, wherein the fiber-forming device is a spinnerette.

6. The method of claim 1, wherein the fiber-forming device is a melt-blowing die.

7. The method of claim 1, further comprising heating the semi-molten fibers during discharging of the semi-molten fibers from the fiber-forming device onto the screen assembly so as to control and maintain a desired melt viscosity of the semi-molten fibers.

8. The method of claim 1, wherein the stack of the semi-molten fibers includes a plurality of first semi-molten fibers and a plurality of second semi-molten fibers, the first semi-molten fibers being formed by melting first resin pellets to form a first melt, followed by feeding the first melt through a spinnerette, the second semi-molten fibers being formed by melting second resin pellets to form a second melt, followed by feeding the second melt through a melt-blowing die.

9. The method of claim 1, further comprising a heater for heating the semi-molten fibers during discharging of the semi-molten fibers from the fiber-forming device onto the screen assembly.

10. The method of claim 4, wherein the screen wall body serves as a conveyor belt trained on and driven by a pair of driving wheels.

* * * * *